US005380084A

United States Patent [19]

Milstead

[11] Patent Number: 5,380,084

[45] Date of Patent: Jan. 10, 1995

[54] ASPHALT DRUM MIXER WITH SELF-SCOURING DRUM

[75] Inventor: John Milstead, Chattanooga, Tenn.

[73] Assignee: Astec Industries, Inc., Chattanooga, Tenn.

[21] Appl. No.: 156,436

[22] Filed: Nov. 23, 1993

[51] Int. Cl.[6] ..... B28C 5/46

[52] U.S. Cl. ..... 366/25; 366/66; 34/183; 432/118

[58] Field of Search ..... 366/22-25, 366/56-58, 66-67, 225, 228, 305, 312, 313; 432/110, 118; 34/135-137, 182, 183

[56] References Cited

U.S. PATENT DOCUMENTS

| | | | |
|---|---|---|---|
| 1,934,930 | 11/1933 | Kent | 34/137 X |
| 4,813,784 | 3/1989 | Musil | 432/118 X |
| 4,867,572 | 9/1989 | Brock et al. | 366/25 |
| 5,052,810 | 10/1991 | Brock | 366/25 |
| 5,083,870 | 1/1992 | Sindelar et al. | 366/25 |
| 5,197,205 | 3/1993 | Spada et al. | 34/183 X |
| 5,261,738 | 11/1993 | Brock | 366/25 |

FOREIGN PATENT DOCUMENTS

| | | | |
|---|---|---|---|
| 1344719 | 10/1963 | France | 366/320 |
| 820109 | 11/1951 | Germany | 366/329 |

*Primary Examiner*—David A. Scherbel
*Assistant Examiner*—Charles Cooley
*Attorney, Agent, or Firm*—Nilles & Nilles

[57] ABSTRACT

A drum mixer for heating and drying stone aggregate as part of a process of continuous production of asphalt paving composition, the drum mixer including: an elongate hollow rotatable drum having a length and an outer surface, the elongate hollow rotatable drum defining a central axis, a sleeve having an inner surface, the sleeve being mounted coaxially with the elongate hollow rotatable drum about the central axis and around at least a portion of the length of the elongate hollow rotatable drum and so as to define an annular chamber having an entire distance between the outer surface of the elongate hollow rotatable drum and the inner surface of the sleeve, and structure for mixing hot mix asphalt in the annular chamber including rake flights mounted on the outer surface of the elongate hollow rotatable drum and in the annular chamber including scouring structure for lifting hot mix asphalt up from a lower portion of the annular chamber along the inner surface of the sleeve through the annular chamber and onto an upper portion of the outer surface of the elongate hollow rotatable drum, the scouring structure including a plurality of shaped scouring fingers extending radially toward the outer surface of the elongate hollow rotatable drum so as to break-up hot mix asphalt and allow hot mix asphalt to fall through the rake flights and onto the upper portion of the outer surface of the elongate hollow rotatable drum, thereby scouring the outer surface of the elongate hollow rotatable drum.

15 Claims, 4 Drawing Sheets

ASPHALT DRUM MIXER WITH SELF-SCOURING DRUM

BACKGROUND OF THE INVENTION

1. Field of the Invention

The present invention relates generally to asphalt drum mixers. More particularly, the present invention relates to an asphalt drum mixer having a self-cleaning drum.

2. Background of the Related Art

Asphalt drum mixers having a counterflow dryer and a separate mixing device are required in some jurisdictions to meet strict air pollution laws. In these highly desirable asphalt drum mixers, the drum is constructed so that the heated gas flows counter to the direction of movement of the aggregate. A mixer of this type is disclosed in U.S. Pat. No. 4,867,572 to Brock et al. More particularly, in the drum mixer of the Brock et al. patent, a fixed sleeve surrounds the lower portion of the rotating drum so that the heated and dried aggregate is discharged into the annular chamber which is formed between the drum and sleeve. Also, an inlet is provided in the sleeve by which recycled asphalt pavement (RAP) may be introduced into the annular chamber, and another inlet is provided to introduce liquid asphalt into the annular chamber. The drum mounts mixing blades which are positioned in the annular chamber to mix the materials and cause them to be moved longitudinally to the discharge outlet of the sleeve.

The quality of the hot mix asphalt is directly related to the quality of mixing in the annular chamber. Conventional mixing blades mounted on the drum are flat paddle-like elements mounted at approximately a 45° angle to the horizontal. As the mixing blades pass through the hot mix asphalt laying on the bottom of the annular chamber, they cause the hot mix asphalt to move longitudinally toward the discharge outlet but do not lift the hot mix asphalt to any appreciable degree. By the time the mixing paddles travel to a position 90° beyond their lowermost position, the hot mix has fallen off and the mixing paddles continue to travel around the annular chamber bare until they again contact the hot mix asphalt at the bottom of the annular chamber. Furthermore, at least some portion of the surface of the drum is continuously in contact with the hot mix asphalt in the bottom of the annular chamber and, in time, becomes coated with the mix, as well as with fines suspended in the annular chamber. Eventually, the build up of material on the outer surface of the rotating drum must be cleaned, requiring substantial down time.

SUMMARY OF THE INVENTION

A self-cleaning asphalt drum mixer is presented. The self-cleaning asphalt drum mixer of the present invention comprises a rotating drum within a fixed sleeve which defines an annular chamber and means mounted on the drum and in the annular chamber which pass through the hot mix asphalt laying in the bottom of the annular chamber and lift it up and onto the top of the rotating drum. The rotating drum is showered with hot mix asphalt which scours and cleans the undesirable build-up on the outside of the drum.

In one preferred embodiment, the scouring means may comprise rake-like flights which lift hot mix asphalt onto the top of the drum. The rake-like flights are mounted at less of an angle with respect to the horizontal than are conventional paddles, thereby slowing the forward progression of the hot mix asphalt through the annular chamber. The rake-like flights have spaced fingers which promote sheering of the hot mix asphalt as the flights pass through the hot mix asphalt at the bottom of the annular chamber. The spaced fingers also allow the hot mix asphalt to drop between the fingers as the flight rotates toward the top of the drum thus providing a continuous shower of hot mix asphalt over the upper surfaces of the drum thus scrubbing off any build-up. The rake-like flights are larger than conventional paddles in that they span the gap between the outer surface of the drum and the inner surface of the fixed outer sleeve in order to promote lifting.

DETAILED DESCRIPTION OF THE PREFERRED EMBODIMENTS

Figure 1:
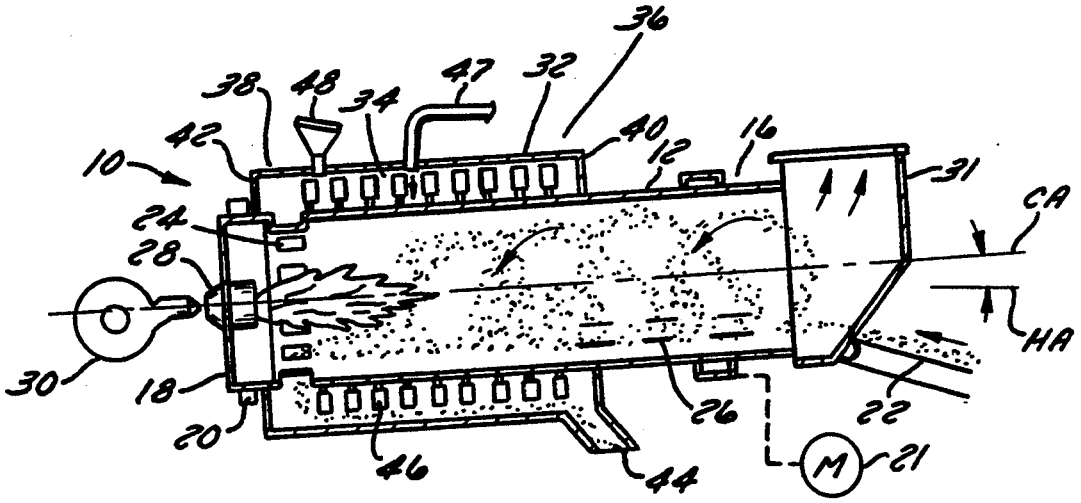
FIG. 1 is a sectioned side elevation view of a drum mixer which embodies the features of the present invention.

FIG. 1 illustrates a drum mixer 10 in accordance with one preferred embodiment of the present invention. The mixer comprises an elongate hollow drum 12 defining a central axis (CA) inclined with respect to the horizontal so as to define an upper end 16 and a lower end 18 of the drum. FIG. 1 views the drum mixer 10 from the side opposite that in FIGS. 3 through 6, and therefore the drum 12 appears to tilt in opposite directions in the two sets of figures.

The drum 12 is rotatably mounted on a frame (not shown) by means of bearings (not shown) mounted to the frame which engage races 20 which are mounted about the circumference of the drum. A motor 21 rotatably drives the drum in a conventional manner and as fully illustrated in U.S. Pat. No. 4,867,572 to Brock et al. incorporated herein by reference in its essentials. An aggregate inlet conveyor 22 is positioned adjacent the upper end 16 of the drum for introducing stone aggregate or the like into the interior of the drum. A plurality of outlet openings 24 are formed about the periphery of the drum at the lower end 18 as described further below.

A plurality of flights or vanes, a few of which are shown at 26, are mounted on the inside of the drum for lifting the aggregate and dropping it through the interior of the drum as it is rotated. Thus, the aggregate which is introduced into the drum via the inlet conveyor 22 is caused to cascade through the interior of the drum and move toward the outlet openings 24 at the lower end 18 of the drum.

The drum mixer 10 further includes a burner 28 which is mounted at the lower end of the drum for directing a high temperature flame into the interior of the drum. The burner 28 is of conventional design and includes a blower 30 which charges a mixture of fuel and air into the burner where it is ignited to produce a flame for heating the interior of the drum. An exhaust duct 31 is positioned at the upper end 16 of the drum which may include an exhaust fan (not shown) for exhausting the heated gas from the drum and so that the heated gas flows through the drum to heat the cascading aggregate. The exhaust air flow may be ducted to a conventional filtering bag house or other dust collector (not shown).

The drum mixer 10 further comprises a fixed sleeve 32 which is mounted coaxially about a portion of the length of the dram 12 adjacent the lower end 18 so that the drum and sleeve define an annular chamber 34 between them. The sleeve 32 is thus similarly inclined to the horizontal so as to define an upper end 36 and a lower end 38. The sleeve 32 also includes annular shoulders 40 and 42 at the upper and lower ends of the sleeve respectively. The shoulders close the annular chamber 34 between the drum and the sleeve, and the lower end 38 of the sleeve 32 overlies the outlet openings 24 of the drum 12 so that the outlet openings open into the annular chamber 34. Thus, the heated and dried aggregate in the lower end of the drum falls into the annular chamber during rotation of the drum. The sleeve 32 further includes a discharge opening 44 adjacent the upper end 36.

A plurality of flights or mixing blades 46 which, as detailed below, are comprised of mixing paddles 74 and rake-like flights 50, for vanes are mounted on the outer circumference of the surface 66 of the drum 12 along the portion of the drum received within the sleeve 32. The blades 46 are configured and angled such that as the blades traverse the annular chamber 34 they engage the aggregate or hot mix asphalt in the annular chamber and move it toward the discharge opening 44 of the sleeve, while causing the aggregate to be mixed.

An inlet 48 positioned adjacent the lower end 38 of the sleeve 32 permits an additive, such as RAP, to be introduced into the annular chamber to be mixed with the aggregate therein. Further, a liquid asphalt supply pipe 47 communicates with the annular chamber 34 for introducing liquid asphalt into the chamber so as to be mixed with the aggregate and the RAP therein. The resulting asphalt paving composition is discharged through the discharge opening 44 of the sleeve 32.

Figure 2B:
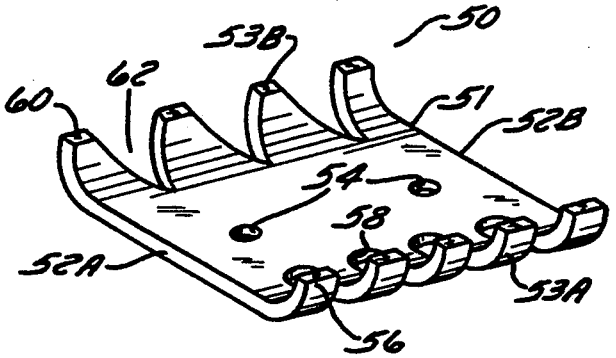
FIGS. 2A and 2B are perspective views of a rake-like flight of the present invention.
Figure 2A:
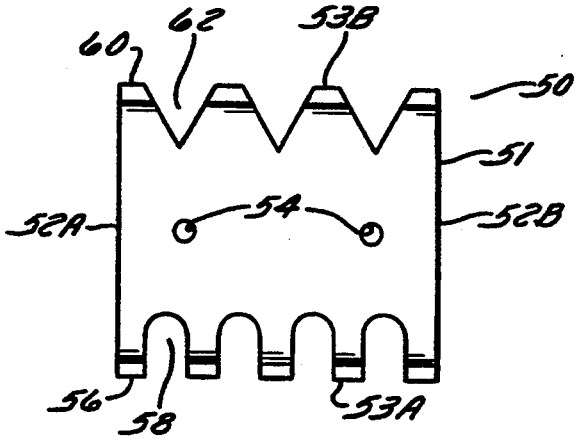

Referring now to FIGS. 2A and 2B, a rake-like flight or mixing paddle or vane 50 of the present invention is depicted. The rake-like flight 50 of the present invention comprises a generally rectangular element 51 having sides **52*a* and 52*b* and ends 53*a* and 53*b*. Mounting holes 54 in the center of the rake-like flight 50 are also shown. The ends 53*a* and 53*b* of the flight 50 are curved upwardly to form a shallow scoop. End 53*a* has finger-like projections 56 separated by spaces 58. Although the exact relative dimensions of the fingers 56 and spaces 58 are determined empirically depending upon the characteristics of the hot mix asphalt to be produced as well as operating characteristics, spaces 58 are generally wider than the fingers 56. End 53*b* has spaced fingers 60 of a slightly different configuration than fingers 56 on end 53*a*, and are separated by spaces 62 of a slightly different shape than spaces 58. The exact spacing and shape of the fingers 60 on end 53*b*** may be determined empirically by considering factors such as the characteristics of the hot mix asphalt desired to be produced as well as operating conditions.

Figure 3:
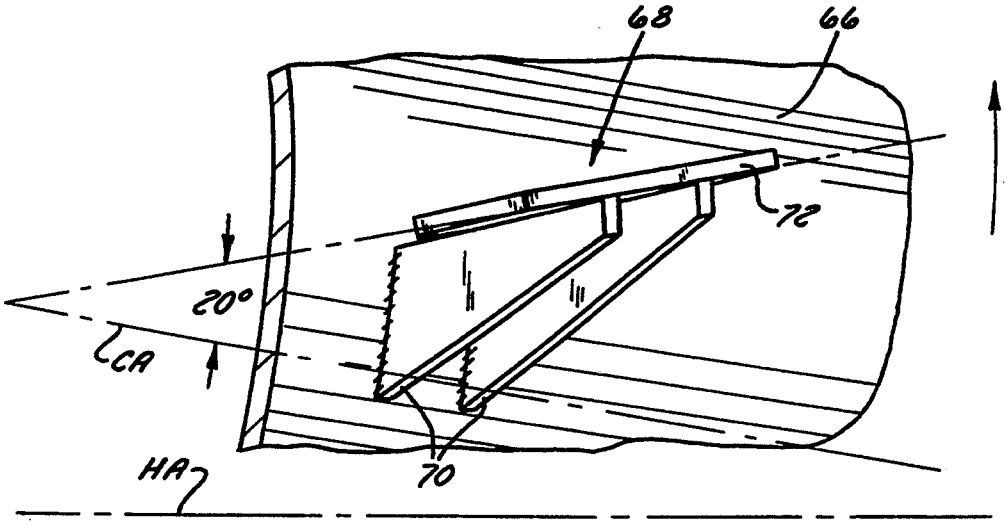
FIG. 3 is a perspective view of the mounting bracket to which the rake-like flights of the present invention are attached on the outer surface of the drum.

Referring now to FIG. 3, a mounting bracket 68 for the flight 50 of the present invention is shown mounted to the outer surface 66 of drum 12. Bracket 68 comprises two support members 70 welded to the outer surface 66 at one end and, at their other end, to mounting plate 72. The rake-like flight 50 of the present invention as shown in FIGS. **2*a* and *b* is attached, such as by welding, to the mounting plate 72 of the mounting bracket 68. Mounting brackets of other configurations may be used but this one has been found to be preferable because it is able to withstand the larger forces generated by the rake-like flight 50 as compared to conventional paddle flights. The rake-like flights 50 of the present invention are of larger size than the conventional paddle elements, as described further below, and therefore must withstand greater forces as they pass through and mix the hot mix asphalt in the bottom of the annular chamber 34**.

Figure 4:
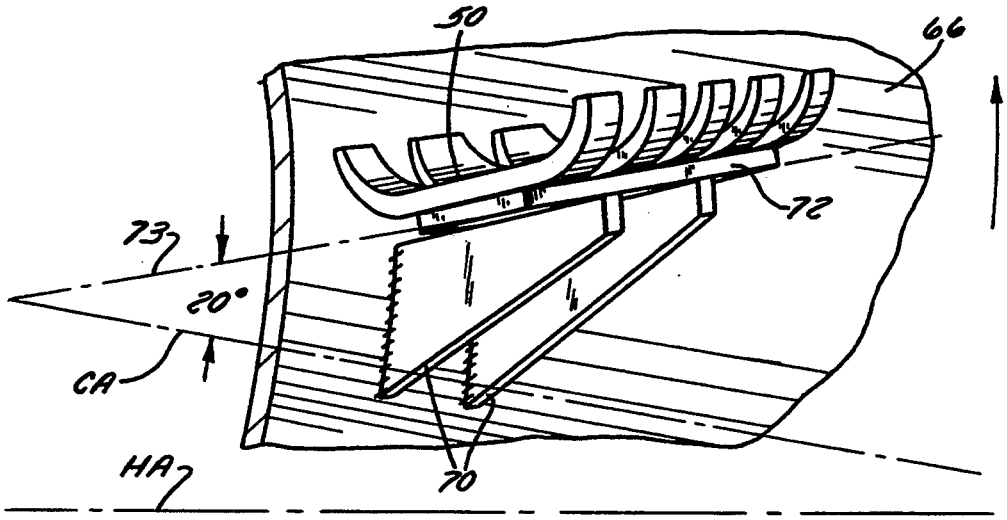
FIG. 4 is a perspective view of a rake-like flight of the present invention mounted on the outer surface of the drum.
Figure 5:
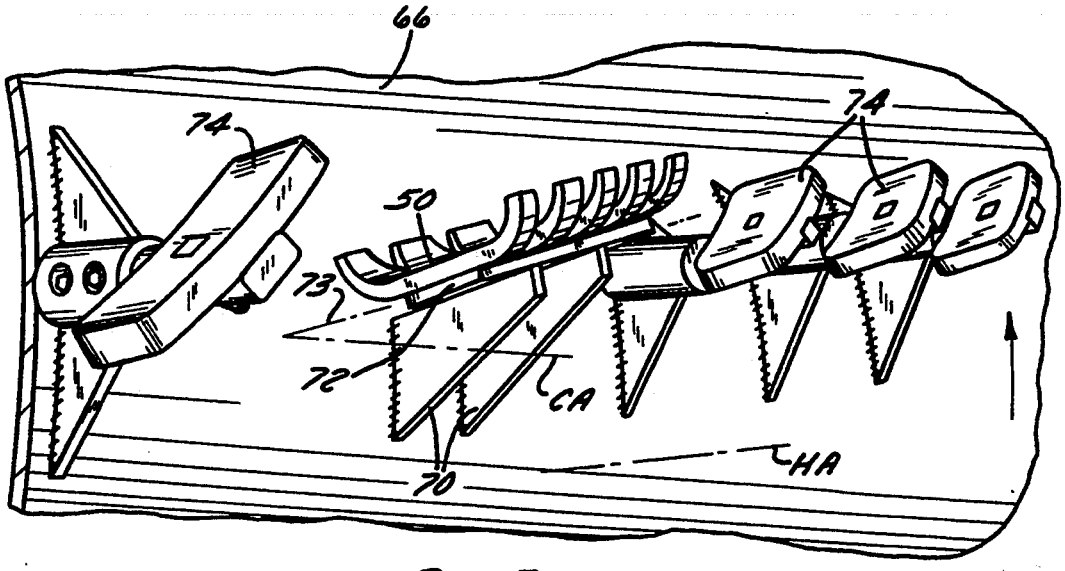
FIGS. 5, 6, and 7 are side perspective views of an asphalt drum mixer of the present invention and showing the rake-like flights of the present invention mounted on the outside surface of the drum alongside conventional mixing paddles.
Figure 6:
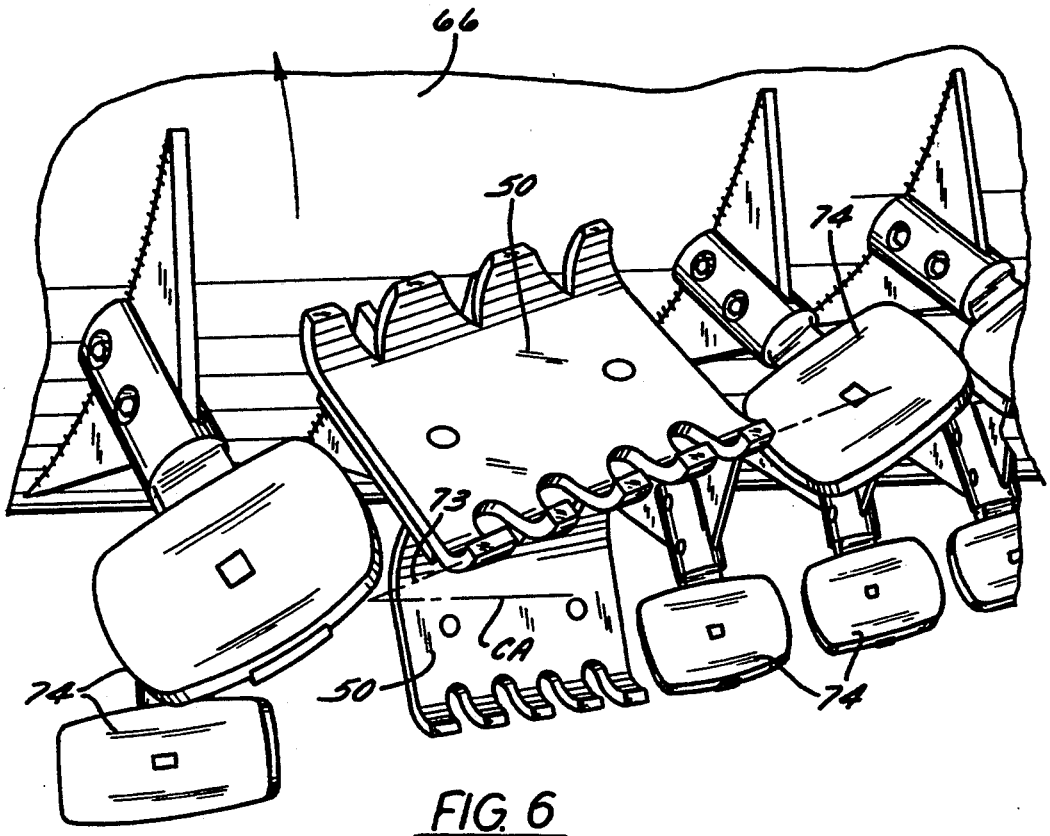

Referring now to FIG. 4, a side view of the outer surface 66 of drum 12 is shown having mounted thereon rake-like flight 50 on mounting plate 72 and attached to the outer surface of the drum 66 on support members 70. It can be seen that the longitudinal axis 73 of the flight 50 is at an angle to the horizontal axis (HA) of the drum of approximately 20°. It can be seen from FIGS. 5 and 6 that the rake-like flights 50 are larger and mounted at a shallower angle with respect to the horizontal than are the conventional mixing paddles 74.

Figure 7:
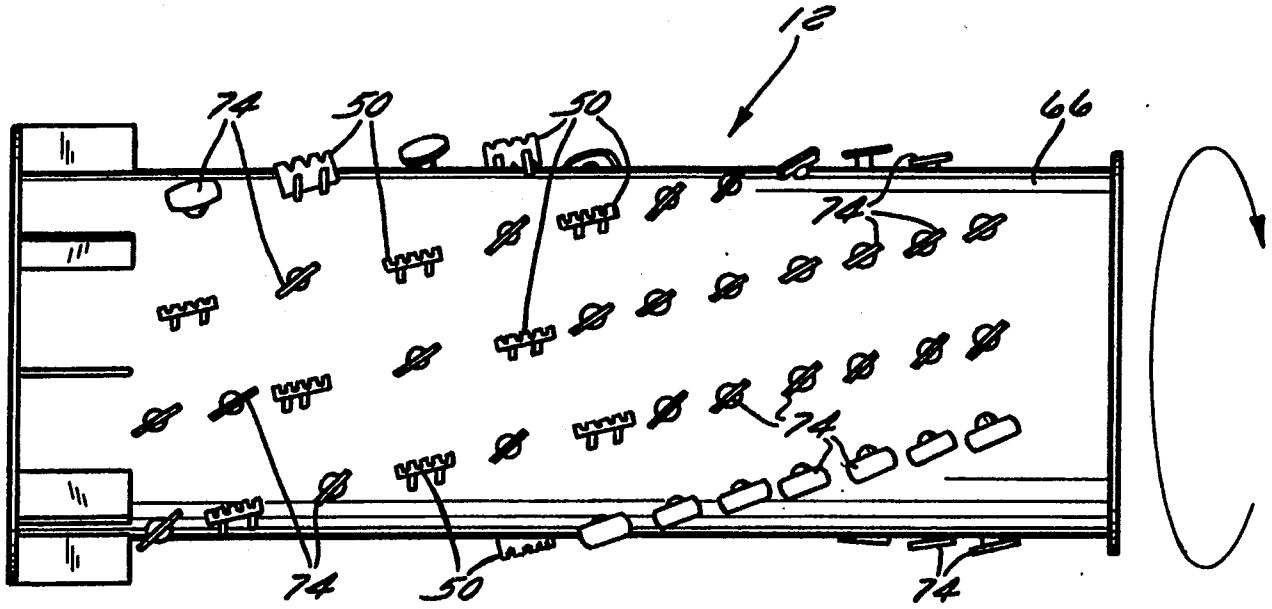

FIG. 7 shows the relative positioning of the rake-like flights 50 of the present invention with respect to conventional mixing paddles 74. As can be seen from FIG. 7, the flights 50 are placed at selected locations on the outer surface 66 of drum 12 replacing the conventional mixing paddles. Generally speaking, it is desirable that the flights 50 be located in the latter half of the drum where build-up is most prevalent. The position of each of the flights 50 as well as its installation angle may be changed for optimum performance and depends upon the size of the drum, mix formulas, and operating conditions.

A typical cycle of operation can be described as follows. Referring again to FIG. 1, virgin aggregate enters the drum 12 on the conveyor 22 and travels toward the burner 28, and hot aggregate falls from the rotating drum 12 into the annular chamber 34 through the outlets 24 at the lower end 18 of the drum. The virgin aggregate is quickly moved away from the outlet 24 by screw flights (not shown) toward the paddles 46 which continue to move the material toward the discharge opening 44. At selected locations on the drum, the rake-like flights 50 sheer through the flow of hot mix asphalt and lift it up and drop it onto the outer surface 66 of the drum 12. The showering material cleans or scours build-up on the outer surface 66 of the drum.

Additionally, sheering is achieved by the spaces 58 and 62 between the fingers 56 and 60 respectively on the flights 50. The curved ends 53A and 53B scoop hot mix asphalt at the bottom of the annular chamber 34 as they sheer through the mix lifting the mix up and allowing a steady stream of mix to fall through the spaces 58 and 62 onto the drum. Sheering between the liquid and the aggregate is maximized as the hot mix drops through the rake-like flights 50. This provides an excellent mixing action which surpasses that possible in a single shaft mixer.

The flights 50 also increase resident time of the hot mix asphalt in the annular chamber 34. This provides additional opportunity for sheering and mixing of the hot mix asphalt. While the conventional paddles 74 are positioned at a 45° angle to the horizontal and therefore act as a segmental screw, the rake-like flights 50 are oriented at less of an angle with respect to the horizontal or center axis (CA) of the drum, for example 20°. This reduced angular orientation of the flights 50 reduces the forward progression of the hot mix asphalt at each of the rakes. Instead, the rakes act to lift up the hot mix asphalt in a direction perpendicular to the direction of forward travel, scouring the drum 66, and increasing shearing and resident time.

The width of the annular chamber 34 in a typical asphalt mixer having an inner rotating drum and an outer fixed sleeve is on the order of 17". The width of the flights 50 from end 53*a* to end 53*b* is preferably on the order of 14", leaving only approximately 1½" between the end 53*a* and the outer sleeve, and 1½" between the end 53*b* and the outer surface 66 of the drum 12. This leaves relatively little room for the hot mix asphalt to fall off the ends of the flights 50 between the flights and either the outer sleeve 32 or the outer surface 66 of the drum 12, thereby ensuring the desired sheering action as asphalt and aggregate falls through the spaces 58 and 62 in the flights 50 and also ensuring significant lifting of the hot mix asphalt up and onto the top surface of the outer surface 66 of the drum 126. The size and shape of the flights 50 may preferably be designed for optimum scouring of the drum and sheering of the hot mix asphalt in each application.

It can also be seen from FIG. 7 that the rake-like flights 50 are selectively positioned about the outer surface 66 of the drum 12 so that all of the hot mix asphalt in the bottom of the annular chamber 34 toward the discharge end of the drum 12 is adequately lifted to ensure scouring, and sheered to ensure superior mixing.

It is to be understood that embodiments of the present invention not disclosed herein are fully intended to be within the scope of the appended claims. For instance, while the invention has been disclosed and described with respect to an asphalt mixer having a counterflow dryer, it is equally applicable to mixers having parallel flow dryers.

I claim:

1. A drum mixer for heating and drying stone aggregate as part of a process of continuous production of asphalt paving composition, said drum mixer comprising:

an elongate hollow rotatable drum having a length and an outer surface, said elongate hollow rotatable drum defining a central axis, a sleeve having an inner surface, said sleeve being mounted coaxially with said elongate hollow rotatable drum about said central axis and around at least a portion of the length of said elongate hollow rotatable drum and so as to define an annular chamber having an entire distance between said outer surface of said elongate hollow rotatable drum and said inner surface of said sleeve, and means for mixing hot mix asphalt in said annular chamber comprising rake flights mounted on said outer surface of said elongate hollow rotatable drum and in said annular chamber comprising scouring means for lifting hot mix asphalt up from a lower portion of said annular chamber along said inner surface of said sleeve through said annular chamber and onto an upper portion of said outer surface of said elongate hollow rotatable drum, said scouring means comprising a plurality of shaped scouring fingers extending radially toward said outer surface of said elongate hollow rotatable drum so as to break-up hot mix asphalt and allow hot mix asphalt to fall through said rake flights and onto said upper portion of said outer surface of said elongate hollow rotatable drum, thereby scouring said outer surface of said elongate hollow rotatable drum.

2. The invention as defined in claim 1 wherein said rake flights extend substantially the entire distance between said outer surface of said elongate hollow rotatable drum and said inner surface of said sleeve.

3. The invention as defined in claim 1, wherein each of said rake flights comprises a plurality of spaced fingers extending radially away from said outer surface of said elongate hollow rotatable drum.

4. The invention as defined in claim 3, wherein each of said plurality of spaced fingers extending radially away from said outer surface of said elongate hollow rotatable drum is curved so as to form a scoop member.

5. A drum mixer for heating and drying stone aggregate in the continuous production of asphalt paving composition, said drum mixer comprising:

an elongate hollow rotatable drum defining a central axis, a sleeve mounted coaxially about at least a portion of the length of said drum and so as to define an annular chamber between said drum and said sleeve, and means for mixing hot mix asphalt in said annular chamber, said means comprising rake-like flights mounted on said drum in said annular chamber, said rake-like flights lifting said hot mix asphalt up and onto the upper portion of said drum while allowing hot mix asphalt to fall through said rake-like flights while being lifted onto said upper portion, wherein said rake-like flights have a first end and a second end, said first and second ends having spaced fingers, said fingers of said first end being oriented toward said drum and said fingers of said second end being oriented toward said sleeve.

6. The invention as defined in claim 5 wherein said rake-like flights have a flat central portion and said first and second ends are curved with respect to said flat central portion and in the same direction to form a scoop-like member.

7. A drum mixer for heating and drying stone aggregate in the continuous production of asphalt paving composition, said drum mixer comprising:

an elongate hollow rotatable drum defining a central axis, a sleeve mounted coaxially about at least a portion of the length of said drum and so as to define an annular chamber between said drum and said sleeve, and means for mixing hot mix asphalt in said annular chamber, said means comprising rake-like flights mounted on said drum in said annular chamber, said rake-like flights lifting said hot mix asphalt up and onto the upper portion of said drum while allowing hot mix asphalt to fall through said rake-like flights while being lifted onto said upper portion, wherein said means for mixing further comprises a plurality of rows of paddles, said rows being at an angle to the central axis of the drum and said paddles in each of said rows being mounted at an angle to each of said rows, said rake-like flights being mounted at selected locations in each of said rows and taking the place of a paddle at each said location.

8. The invention as defined in claim 7 wherein said rake-like flights have a central portion having a longitudinal axis, said longitudinal axis being at an angle to said rows which is less than the angle that each of said paddles makes with respect to said rows.

9. The invention as defined in claim 7 wherein said rake-like flights are mounted toward a discharge end of said sleeve.

10. The invention as defined in claim 7 wherein each said row has at least two of said rake-like flights.

11. A drum mixer adapted for heating and drying stone aggregate in the continuous production of asphalt paving composition, and comprising an elongate hollow drum defining a central axis, said central axis being inclined with respect to the horizontal so as to define an upper end and a lower end of said drum, aggregate inlet means positioned adjacent said upper end of said drum for introducing aggregate into the interior of said drum, aggregate outlet means positioned adjacent said lower end of said drum for withdrawing the aggregate from the interior of said drum, means for rotating said drum about said central axis so as to cause the aggregate which is introduced at said inlet means to cascade through the interior of said drum and move to said outlet means, heating means positioned adjacent one of said ends of said drum for introducing heated gas into the interior of said drum, exhaust duct means positioned adjacent the other of said ends of said drum for exhausting the heated gas therefrom and so that the heated gas flows through said drum and through the cascading aggregate, a fixed sleeve mounted coaxially about at least a portion of the length of said drum and so as to define an annular chamber between said drum and said sleeve, said sleeve having a lower end overlying said outlet means of said drum and an upper end positioned intermediate said ends of said drum, with said outlet means of said drum opening into said annular chamber so that said annular chamber receives the heated and dried aggregate from said outlet means, and with said sleeve .further including a discharge opening adjacent said upper end thereof, mixing vane means mounted to the exterior of said drum so as to be positioned within said annular chamber for lifting and mixing the aggregate received therein upon rotation of said drum and moving the aggregate toward said discharge opening of said sleeve, and said mixing vane means having two ends, each end having spaced fingers, said fingers of said first end oriented toward said drum and said fingers of said second end oriented toward said sleeve, for lifting said aggregate and lifting it up and onto said drum, said mixing vane means also comprising paddles for moving the aggregate toward said discharge opening of said sleeve.

12. The invention as defined in claim 11 further comprising means positioned adjacent said lower end of said sleeve for introducing an additive into said annular chamber so as to be mixed with the aggregate therein.

13. The invention as defined in claim 12 further comprising means for introducing liquid asphalt into said annular chamber so as to be mixed with the aggregate and the additive therein.

14. The drum mixer as defined in claim 11 wherein said heating means is positioned adjacent said lower end of said drum so that said aggregate moves through said drum in a direction counter to the direction of the gas-flow through said drum.

15. The invention as defined in claim 11 wherein said heating means comprises a burner for directing a high temperature flame into said drum, and airblower means for supplying air to said burner.

* * * * *